US006369514B2

(12) United States Patent
Awamoto

(10) Patent No.: US 6,369,514 B2
(45) Date of Patent: Apr. 9, 2002

(54) METHOD AND DEVICE FOR DRIVING AC TYPE PDP

(75) Inventor: Kenji Awamoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/729,092

(22) Filed: Dec. 5, 2000

(30) Foreign Application Priority Data

Mar. 13, 2000 (JP) ..... 12-067977

(51) Int. Cl.[7] ..... G09G 3/28
(52) U.S. Cl. ..... 315/169.1; 345/67; 345/68
(58) Field of Search ..... 315/169.1–169.4; 345/55, 61, 62, 67, 68, 90

(56) References Cited

U.S. PATENT DOCUMENTS 6,054,970 A * 4/2000 Hirakawa et al. ..... 345/67
6,295,040 B1 * 9/2001 Nhan et al. ..... 345/67

FOREIGN PATENT DOCUMENTS

EP 0 657 861 6/1995
EP 0 762 373 3/1997
EP 0 810 577 12/1997

* cited by examiner

*Primary Examiner*—Don Wong
*Assistant Examiner*—Wilson Lee
(74) *Attorney, Agent, or Firm*—Staas & Halsey LLP

(57) ABSTRACT

A method and a device for driving an AC type PDP are provided in which addressing that cannot be affected by a change of an operation environment can be realized without increasing withstand voltage of circuit components, so that the display can be stabilized. An address period TA in which the addressing is performed is divided into plural subperiods TA1, TA2, and different rows are selected for subperiods. In each subperiod, a bias switching is performed for the second electrode of the row that is selected in the period between a selection potential Vya1 and a first non-selection potential Vya2 in accordance with the selection and the non-selection. In addition, the second electrodes of the rows that are selected in the succeeding subperiod are maintained at the second non-selection potential Vya3 that is closer to the address potential Vaa than to the first non-selection potential Vya2.

12 Claims, 15 Drawing Sheets

FIG. 13 *PRIOR ART*
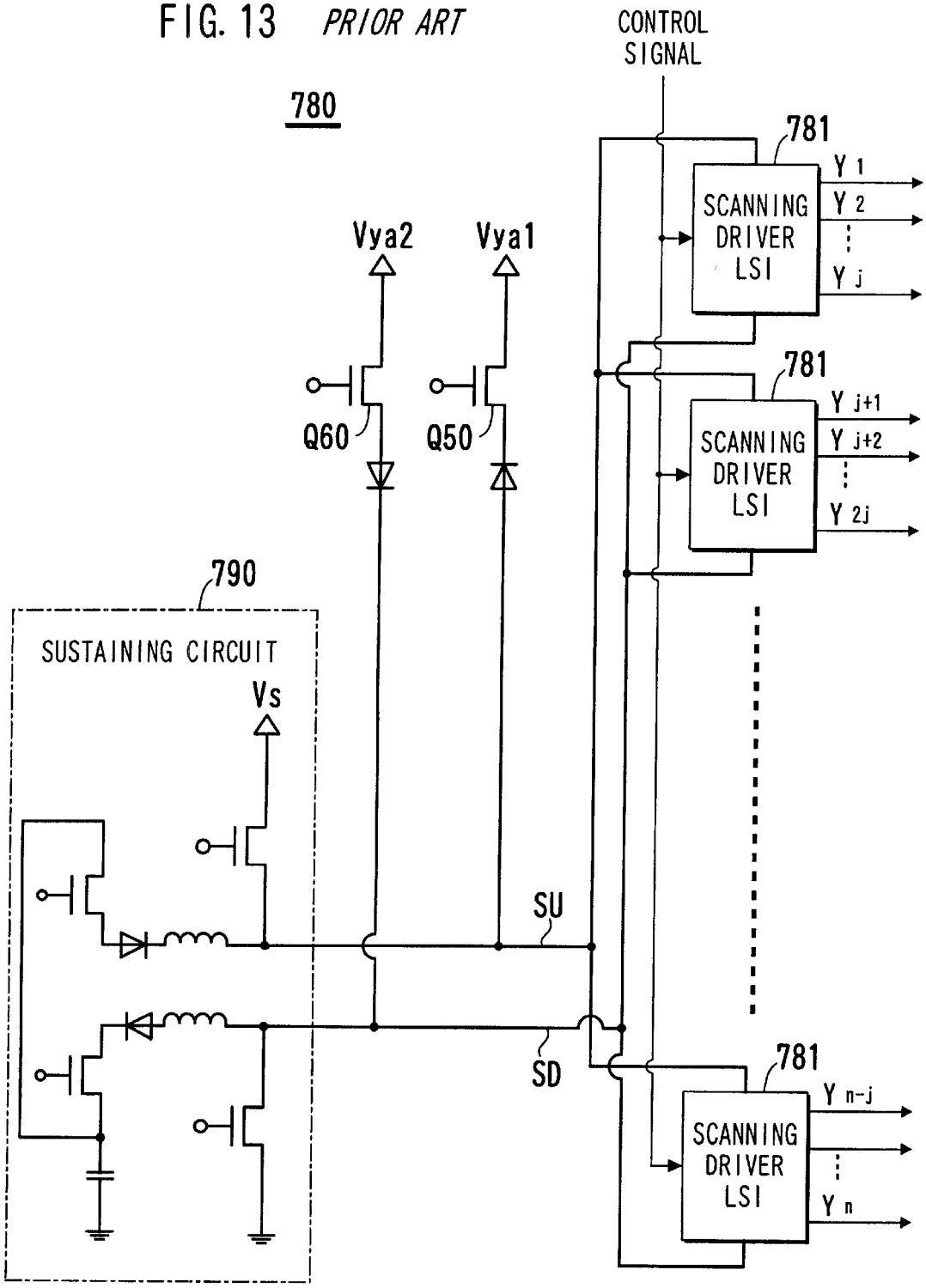

FIG. 14 *PRIOR ART*
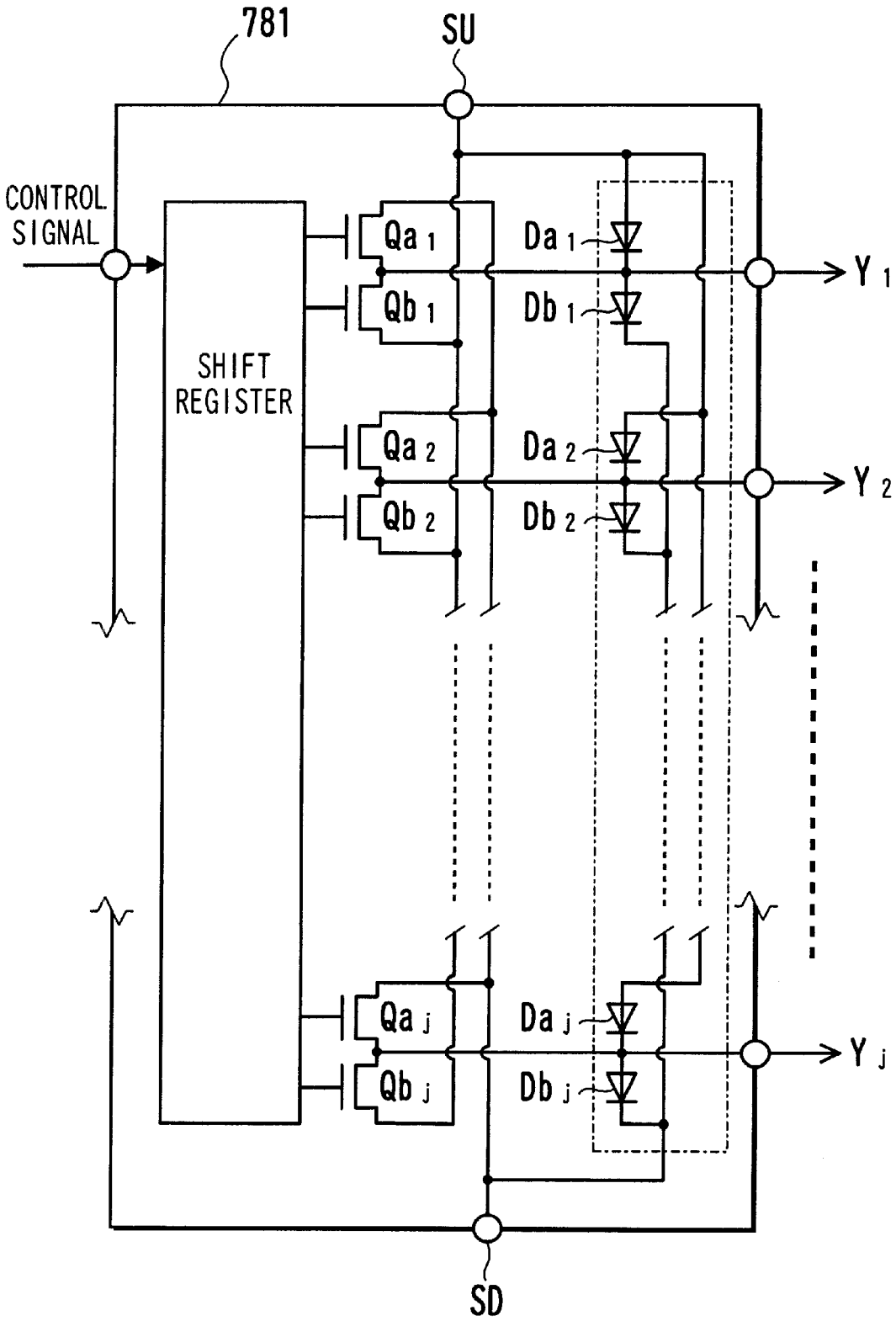

FIG. 15 *PRIOR ART*
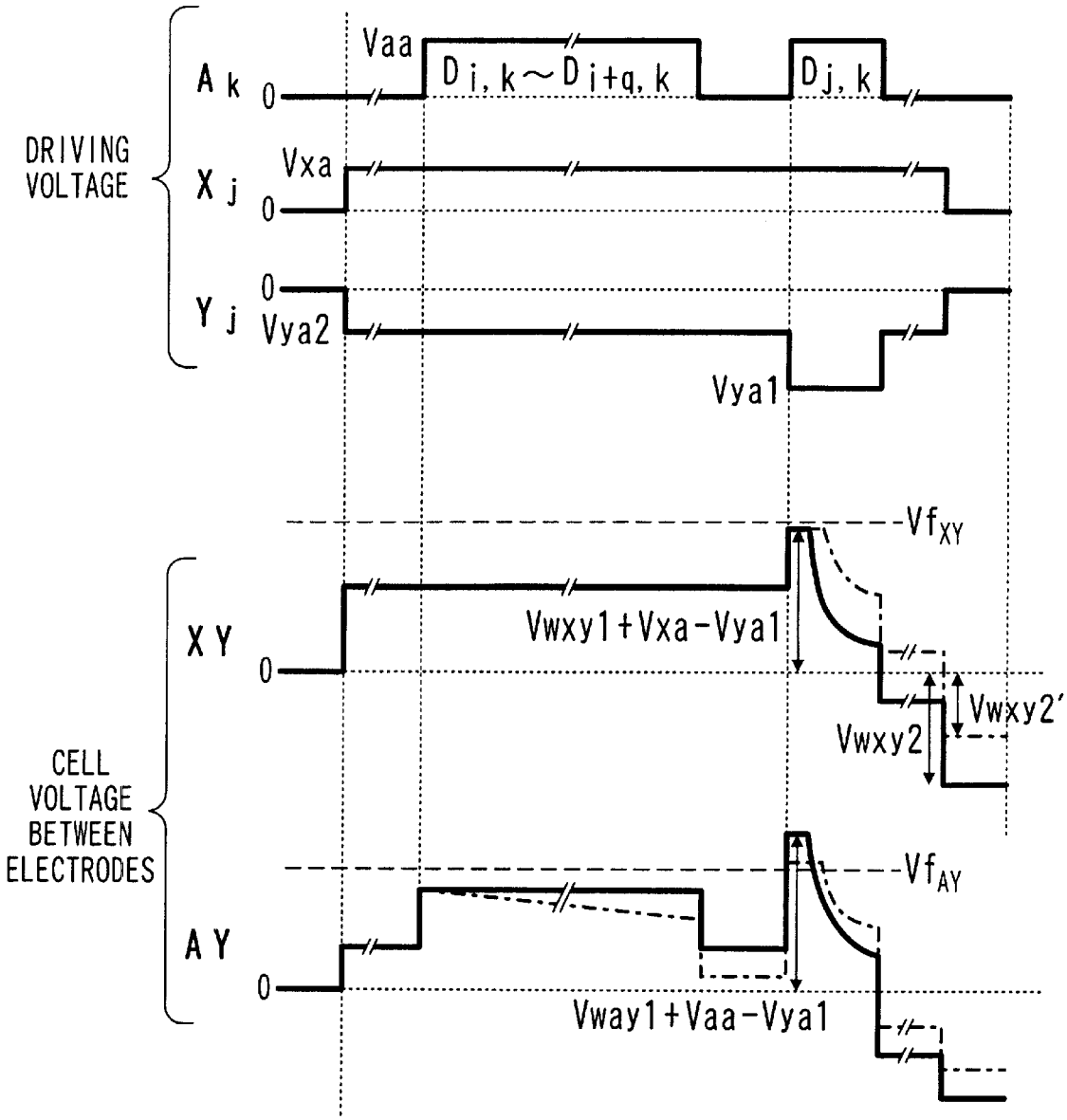

METHOD AND DEVICE FOR DRIVING AC TYPE PDP

BACKGROUND OF THE INVENTION

1. Field of the Invention

The present invention relates to a method and a device for driving an AC type PDP.

A PDP (plasma display panel) is used widely for a television set or a monitor display of a computer, taking the occasion of a practical use of a color screen. Along with the widespread use, the use environment has become diversified, so a driving method for a stable display is required that is not affected by variations of the temperature and the power source voltage.

2. Description of the Prior Art

As a color display device, a surface discharge AC type PDP is commercialized. The surface discharge is a format in which display electrodes (first electrodes and second electrodes) that become anodes and cathodes in the display discharge for securing a luminance are arranged in parallel on the front or the rear substrate, and third electrodes (address electrodes) are arranged to cross the display electrode pair. There are two forms of the display electrode arrangement. In one form, a pair of display electrodes is arranged for each row of the matrix display. In the other form, the first and the second display electrodes are arranged alternately at a constant distance. In the latter case, the display electrodes except the both ends of the arrangement are related to the two neighboring row display. Regardless of the arrangement, the display electrode pair is covered with a dielectric.

In the surface discharge format PDP, an addressing is performed in which one (the second electrode) of the display electrode pair corresponding to each row is used as a scan electrode for row selection, and an address discharge is generated between the scan electrode and the address electrode. The address discharge triggers another address discharge between the display electrodes, so that a charge quantity (a wall charge quantity) in the dielectric is controlled in accordance with contents of the display. After the addressing, a sustaining voltage Vs having an alternating polarity is applied between the display electrodes. The sustaining voltage Vs satisfies the following inequality.

$$Vf_{XY}-Vw_{XY}<Vs<Vf_{XY} \quad (1)$$

$Vf_{XY}$ is the discharge start voltage between the display electrodes.

$Vw_{XY}$ is the wall voltage between the display electrodes.

When increasing the sustaining voltage Vs, the cell voltage (the sum of the driving voltage applied to the electrode and the wall voltage) exceeds the discharge start voltage $Vf_{XY}$ only in cells having a predetermined wall charge, so that the surface discharge occurs along the substrate surface. If the application period is shortened, the light emission becomes continuous visually.

A discharge cell of a PDP is a binary light emission element. Therefore, a half tone is reproduced by setting an integral light emission quantity of each discharge cell in the frame period in accordance with a gradation value of the input image data. The color display is a type of a gradation display, and the display color is determined by a combination of luminance values of three primary colors. The gradation display utilizes a method of constituting one frame with plural subframes (subfields in an interlace display) having a weight of luminance, and of setting an integral light emission quantity by a combination of on and off of the light emission of each subframe. For example, one frame is divided into eight subframes having the luminance weights of 1, 2, 4, 8, 16, 32, 64 and 128, respectively so as to perform the 256-step gradation display. In general, weight of the luminance is set by the number of light emissions.

FIG. 11 is a diagram showing voltage waveforms of a general driving sequence. The reference characters X, Y and A denote the first electrode, the second electrode and the third electrode, respectively. The suffixes 1–n of the reference characters X and Y indicate the arrangement order of the rows corresponding to the electrodes X, Y. The suffixes 1–m of the reference character A indicate the arrangement order of the column corresponding to the electrode A.

The subframe period Tsf that is assigned to each subframe includes a preparation period TR for equalizing a charge distribution of the screen, an address period TA for forming the charge distribution corresponding to the display contents by applying a scanning pulse Py and an address pulse Pa, and a sustaining period TS for securing the luminance corresponding to the gradation value by applying a sustaining pulse Ps. Though the length of the preparation period TR and the address period TA is constant regardless of the luminance weight, the length of the sustaining period TS is longer for a larger luminance weight. The illustrated waveform is an example, and the amplitude, the polarity and the timing can be changed variously. A method of controlling the charge quantity by applying a ramp waveform pulse is preferable for equalizing the charge distribution.

FIG. 12 is a diagram showing driving voltage waveforms in the conventional address period.

In the address period TA, concerning the second electrode Y that is used as a scan electrode for row selection of the screen having n rows and m columns, an individual potential control is performed. After biasing all second electrodes Y to the non-selection potential Vya2 at the start point of the address period TA, the second electrode Y corresponding to the selected row i ($1 \leqq i \leqq n$) is biased to the selected potential Vya1 temporarily (application of the scanning pulse). The illustrated row selection order is the same as the arrangement order of the row. In synchronization with the row selection, the third electrode A of the column including the selected cell that generates the address discharge among the selected row is biased to the selection potential Vaa (application of the address pulse). The third electrode A of the column including the non-selected cell is biased to the ground potential (normally, 0 volt). The first electrode X is biased to a constant potential Vxa from the start to the end of the addressing regardless of whether the row is the selected row or the non-selected row. The potential Vxa is set so that the cell voltage between the electrodes X and Y when the scanning pulse is applied to the second electrode Y is a little lower than the discharge start voltage $Vf_{XY}$. Thus, when an address discharge occurs between the third electrode A and the second electrode Y, the address discharge triggers another discharge between the electrodes X and Y (hereinafter, referred to as an address discharge) to occur. The address discharge is not generated between the electrodes X and Y of the non-selected cell having no trigger.

FIG. 13 is a diagram showing the structure of the conventional scanning circuit. FIG. 14 is a diagram showing a structure of a switch circuit that is called a scanning driver.

The conventional scanning circuit 780 includes plural scanning drivers 781 for binary control of the potential of each of the n second electrodes Y, and two switches (switching devices such as FETs) Q50, Q60 for switching the voltage that is applied to the scanning drivers. Each scanning driver 781 is an integrated circuit device, which is in charge of controlling the j second electrodes Y. In a typical and available scanning driver 781, j is approximately 60–120. As shown in FIG. 14, in each scanning driver 781, a pair of switches Qa, Qb is arranged for each of the j second electrodes Y. The j switches Qa are connected commonly to the power source terminal SD, and j switches Qb are connected commonly to the power source terminal SU. When the switch Qa turns on, the second electrode Y is biased to the potential of the power source terminal SD at that time. When the switch Qb is turned on, the second electrode Y is biased to the potential of the power source terminal SU at that time. The control signal from the controller is given to the switches Qa, Qb via a shift register, which works for realizing the row selection in a predetermined order. The scanning driver 781 includes diodes Da, Db that become current paths when the sustaining pulse is applied. With reference to FIG. 13, the power source terminals SU of all scanning drivers 781 are commonly connected to the switch Q50, and the power source terminals SD of all scanning drivers 781 are commonly connected to the switch Q60. The switches Q50, Q60 are provided for using the scanning driver 781 also for applying the sustaining pulse. In the address period, when the switch Q50 is turned on, the power source terminal SU is biased to the selection potential Vya1. When the switch Q60 is turned on, the power source terminal SD is biased to the non-selection potential Vya2. In the sustaining period, the switches Q50, Q60 and all switches Qa, Qb in the scanning drivers are turned off. The potentials of the power source terminals SU, SD are controlled by a sustaining circuit 790. The sustaining circuit 790 includes a switch for switching the potential of the second electrode Y between the sustaining potential Vs and the ground potential, and a power recycling circuit that performs charge and discharge of the capacitance between the first electrode X and the second electrode Y at a high speed utilizing an LC resonance.

In a PDP, the inner electrification characteristics depend on an operation temperature, and there is a difference of the electrification state between cells in accordance with a display pattern. For this reason, the conventional driving method has a problem that an addressing error can be generated easily due to an excessive or an insufficient electrification between the third electrode A and the second electrode Y. Hereinafter, this problem will be explained.

FIG. 15 is a diagram showing waveforms of the cell voltage variation in the address period of the conventional driving method. The thick solid line in the figure indicates an appropriate variation of the cell voltage (the sum of the applied voltage and the wall voltage), and the chain line indicates an inappropriate variation of the cell voltage.

Here, a cell of the k-th column in the j-th row of the selection order is noted. A display pattern is supposed in which the third electrode A corresponding to the k-th column is biased to the address potential Vaa in the period before the noted row becomes the selected row and while the selected row is i-th through (i+q)th row (i<i+q<j), i.e., the display data $D_{i,k}$ through $D_{i+q,k}$ of the k-th column in the i-th row through the (i+q)th row are the selected data.

If the operation temperature is appropriate, the wall voltage remains substantially at the initial value in the stage before the noted row becomes the selected row. Therefore, when the noted row becomes the selected row, so that the second electrode $Y_j$ is biased to the selection potential Vya1, and the third electrode $Y_k$ is biased to the address potential Vaa, a cell voltage (Vway1+Vaa−Vya1) between the electrodes A and Y exceeds the discharge threshold level $Vf_{AY}$, and the address discharge occurs. In the almost same time, the address discharge occurs between the electrodes X and Y, too. Because, the cell voltage between the electrodes X and Y (Vwxy1+Vxa−Vya1) is set to a value lower than or very close to the threshold level $Vf_{XY}$. The address discharge changes the wall voltage, so that a charged state is formed that is suitable for the operation in the succeeding sustaining period. In the illustrated example, the initial value of the wall voltage is zero volts, and the address discharge generates the wall voltage Vwxy2 between the electrodes X and Y.

Before the noted row becomes the selected row, even if the third electrode Ak is biased to the address potential Vaa, the discharge must not occur since the cell voltage between the electrodes A and Y in the noted row is lower than the discharge starting threshold level $VF_{AY}$. However, if the ambient temperature rises or heat is accumulated along with the display, the cell temperature becomes higher than the normal temperature. Thus, the cell voltage between the electrodes A and Y becomes close to the discharge starting threshold level $Vf_{AY}$. In this situation, even if the cell voltage is lower than $Vf_{AY}$, a very small discharge can be generated so that the wall voltage between the electrodes A and Y can change. The remaining little quantity of space charge can affect the wall voltage to change. Due to the change of the wall voltage, when the noted row becomes the selected row, the cell voltage between the electrodes A and Y becomes lower than the normal value. Then, the address discharge intensity (the change of the wall voltage generated by the discharge) is reduced. Therefore, the address discharge between the electrodes X and Y that is generated by the trigger of the address discharge between the electrodes A and Y is also reduced, and the change of the wall voltage between the electrodes X and Y decreases. In this case, the wall voltage (Vwxy2') between the electrodes X and Y of the cell to be lighted is insufficient. Therefore, a lighting error can be generated in the succeeding sustaining period, resulting in an irregular display. If the address discharge does not occur between the electrodes X and Y as explained above, the probability of the lighting error is increased.

In order to suppress the undesired change of the wall voltage, the difference between the non-selection potential Vya2 of the second electrode Y and the address potential Vaa of the third electrode A can be decreased. However, the difference between the selection potential Vya1 and the address potential Vaa should be sufficient for ensuring the intensity of the address discharge between the electrodes A and Y. Therefore, making the non-selection potential Vya2 close to the address potential Vaa means enlarging the difference between the selection potential Vya1 of the second electrode Y and the non-selection potential Vya2 and requires the increase of a withstand voltage of the scanning driver 781. As explained above, in the address period, the voltage corresponding to difference between the selection potential Vya1 and the non-selection potential Vya2 is applied between the power source terminal SU and the power source terminal SD of the scanning driver 781. So, the scanning driver 781 should endure this voltage. The increase of the withstand voltage of an integrated circuit bring a substantial increase of a cost of components.

SUMMARY OF THE INVENTION

The object of the present invention is to realize the addressing that is affected little by the change of the operation environment without increasing the withstand voltage of a circuit component, so that the display can be stabilized.

In the present invention, each scan electrode (a second electrode Y) is set to a variable potential state in a part of the address period so that the selected and the non-selected can be distinguished, while it is set to a constant potential state in the remained period so that the potential is not switched. When the potential is not switched, one of the power source terminals of the scanning driver is opened or is maintained at a potential that is the same as or close to the potential of the other power source terminal, so that the limit of the withstand voltage of the scanning driver. Thus, the potential of the scan electrode can be set to any value without worrying about the enlargement of the difference between the potential of the scan electrode and the selection potential Vya1. By making the set potential close to the address potential Vaa of the address electrode (the third electrode A), the cell voltage between the electrodes A and Y can be maintained within the range sufficiently lower than the discharge starting threshold level $Vf_{AY}$. Thus, the undesired change of the wall voltage that is a conventional problem can be hardly generated. Particularly, it is effective to assign a constant potential period before applying the scanning pulse to the noted scan electrode. If the constant potential period is assigned to both before and after applying the scanning pulse, the addressing can be ensured more.

In the period of the variable potential state, an undesired change of the wall voltage can be generated depending on the value of the non-selection potential Vya2. However, since there is a correlation between the change quantity and the period length, the influence of the wall voltage change is little if the period of the variable potential state is short. For example, the address period is divided into the first half and the second half, and the scan electrode that is selected in the second half is maintained at a constant potential, the influence of the wall voltage change becomes approximately a half of that in the conventional driving method.

According to a first aspect of the present invention, a method for driving an AC type PDP is provided. The AC type PDP has a screen including first electrode and second electrodes making electrode pairs for surface discharges of plural rows, and third electrodes of plural columns, each third electrode crossing the electrode pairs. The driving method comprises the steps of biasing the second electrode of a selected row to a selection potential Vya1 for row selection, biasing the third electrode of a selected column to an address potential Vaa that is different from the selection potential Vya1 in synchronization with the row selection so that an addressing discharge can occur, dividing an address period for the addressing into plural subperiods, so that different rows are selected for subperiods, switching the bias of the second electrode of the row selected in each subperiod between the selection potential Vya1 and the first non-selection potential Vya2 in accordance with selection and non-selection, and maintaining the potential of the second electrode of the row to be selected in the succeeding subperiod at a second non-selection potential Vya3 that is closer to the address potential Vaa than to the first non-selection potential Vya2.

According to a second aspect of the present invention, in the driving method, the second electrode of the row that was selected in the previous subperiod is also maintained at the second non-selection potential Vya3 in each subperiod.

According to a third aspect of the present invention, in the driving method, the second non-selection potential Vya3 is the ground potential.

According to a fourth aspect of the present invention, in the driving method, the row selection is performed in the order that is different from the arrangement order of the rows.

According to a fifth aspect of the present invention, in the driving method, the address period is divided into two subperiods. In one of the subperiods the bias of the second electrode of the odd row is switched in accordance with selection and non-selection while the second electrode of the even row is maintained at the second non-selection potential Vya3. In the other of the subperiods, the bias of the second electrode of the even row is switched in accordance with selection and non-selection while the second electrode of the odd row is maintained at the second non-selection potential Vya3.

According to a sixth aspect of the present invention, a device for driving an AC type PDP is provided. The AC type PDP has a screen including first electrode and second electrodes making electrode pairs for surface discharges of plural rows, and third electrodes of plural columns, each third electrode crossing the electrode pairs. The device biases the second electrode of a selected row to a selection potential Vya1 for row selection and biases the third electrode of a selected column to an address potential Vaa that is different from the selection potential Vya1 in synchronization with the row selection so that an addressing discharge can occur. When dividing an address period for the addressing into plural subperiods, the device switches the bias of the second electrode of the row selected in each subperiod between the selection potential Vya1 and the first non-selection potential Vya2 in accordance with selection and non-selection while maintaining the potential of the second electrode of the row to be selected in the succeeding subperiod at a second non-selection potential Vya3 that is closer to the address potential Vaa than to the first non-selection potential Vya2.

According to a seventh aspect of the present invention, the driving device comprises a switch circuit including a first and a second bias terminals for connecting a second electrode to one of the first and second bias terminals, a first switch for controlling continuity between the first bias terminal and a selection potential line, a second switch for controlling continuity between the second bias terminal and the first non-selection potential line, a third switch for controlling continuity between the second bias terminal and the second non-selection potential line, and a controller for opening the third switch in the subperiod while a bias of the second electrode is switched between the selection potential Vya1 and the first non-selection potential Vya2, and for opening the first switch in the subperiod while the potential of the second electrode is maintained at the second non-selection potential Vya3.

According to an eighth aspect of the present invention, in the driving device, a withstand voltage between the first and the second bias terminals of the switch circuit is higher than the potential difference between the selection potential Vya1 and the first non-selection potential Vya2 and is lower than the potential difference between the selection potential Vya1 and the second non-selection potential Vya3.

According to a ninth aspect of the present invention, in the driving device, the switch circuit is an integrated circuit having plural switching devices for connecting each of the plural second electrode to one of the first and the second bias terminals.

According to a tenth aspect of the present invention, in the driving device, the number of rows selected in each subperiod is equal to the number of driving electrodes per one switch circuit.

According to an eleventh aspect of the present invention, in the driving device, the number of rows selected in each subperiod is an integral multiple of the number of driving electrodes per one switch circuit.

According to a twelfth aspect of the present invention, a display device is provided that comprises the driving device of the sixth aspect and an AC type PDP that is driven by the driving device.

BRIEF DESCRIPTION OF THE DRAWINGS

FIG. 13 is a diagram showing the structure of the conventional scanning circuit.

FIG. 14 is a diagram showing a structure of a switch circuit that is called a scanning driver.

FIG. 15 is a diagram showing waveforms of the cell voltage variation in the address period of the conventional driving method.

DESCRIPTION OF THE PREFERRED EMBODIMENTS

Hereinafter, the present invention will be explained more in detail with reference to embodiments and drawings.

Figure 1:
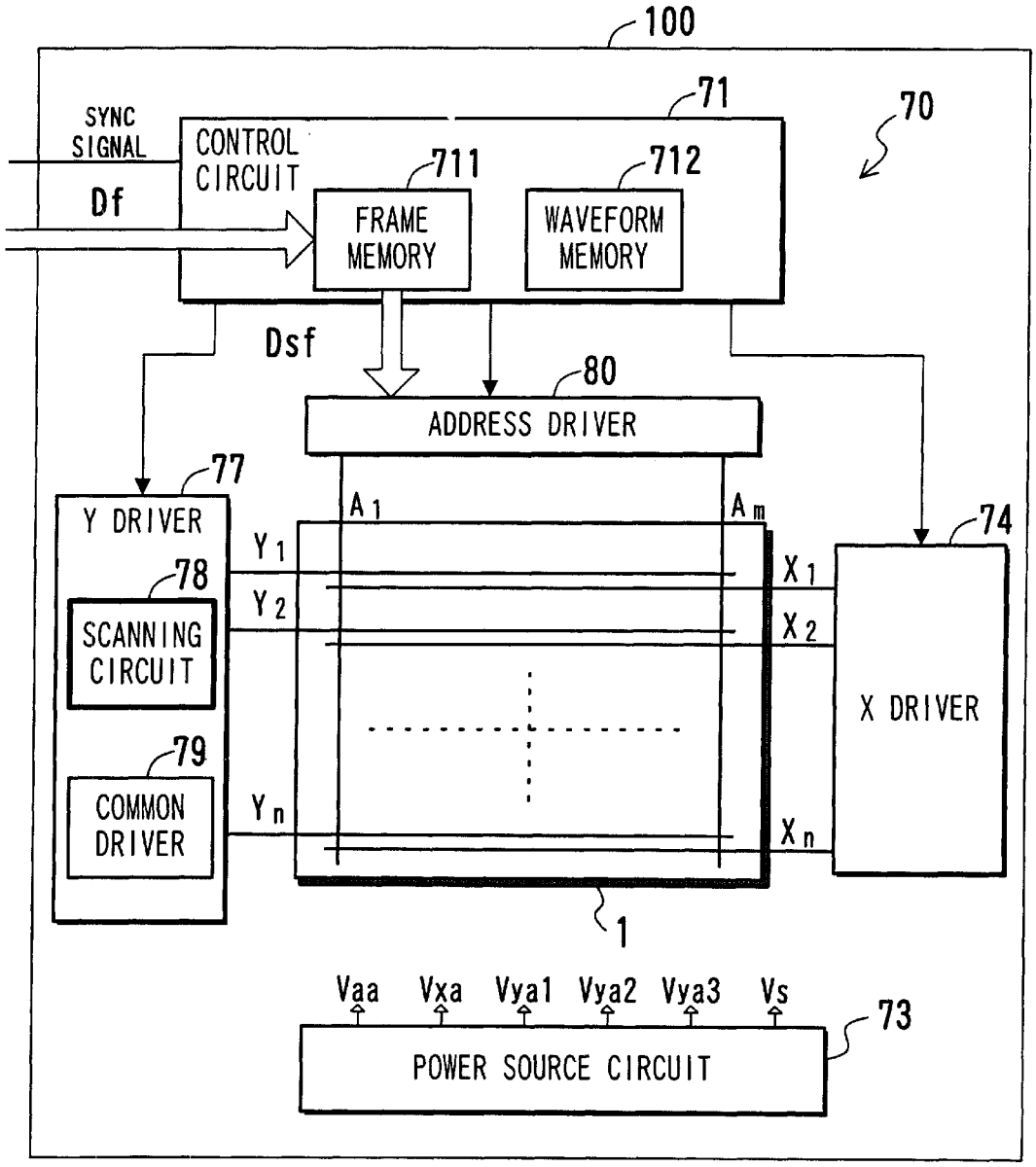
FIG. 1 is a diagram showing a structure of a display device according to the present invention.

FIG. 1 is a diagram showing a structure of a display device according to the present invention. The display device 100 comprises a surface discharge type PDP 1 having a screen of m columns and n rows and a driving unit 70 for selectively letting the discharge cells arranged in a matrix emit light. The display device 100 is used for a wall-hung television set or a monitor display of a computer system.

In the PDP 1, first electrodes X and second electrodes Y for generating a display discharge are arranged in parallel, and third electrodes (address electrodes) A are arranged to cross the first and the second electrodes. The first electrode X and the second electrode Y extend in the row direction (the horizontal direction) of the screen, and the second electrode Y is used as a scan electrode for row selection in the addressing. The third electrode A extends in the column direction (the vertical direction) and is used as a data electrode for column selection.

The driving unit 70 includes a control circuit 71 that is in charge of the driving control, a power source circuit 73, an X driver 74, a Y driver 77, and an address driver 80. Frame data Df that are multivalue image data showing luminance levels of red, green and blue colors are inputted to the driving unit 70 from external equipment such as a TV tuner or a computer along with various synchronizing signals. The control circuit 71 includes a frame memory 711 for temporarily memorizing the frame data Df and a waveform memory 712 for memorizing control data of the driving voltage.

The frame data Df are temporarily stored in the frame memory 711, are converted into subfield data Dsf for the gradation display, and are transferred to the address driver 80. The subfield data Dsf are display data having q bits indicating q subfields (it can be said to be a set of q screens of display data including one bit per one subpixel), and the subfield is a binary image having the resolution of a binary value of m×n. The value of each bit of the subfield data Dsf indicates whether the subpixel of the corresponding subfield requires the light emission, more exactly, whether the address discharge is necessary.

The X driver 74 controls the potential of n first electrodes X as a unit. The Y driver 77 includes a scanning circuit 78 and a common driver 79. The scanning circuit 78 is potential switching means for the row selection in the addressing. The address driver 80 controls the potential of the total m of third electrodes A in accordance with the subfield data Dsf. These drivers are supplied with a predetermined electric power from the power source circuit 73 via wiring conductors (not shown).

Figure 2:
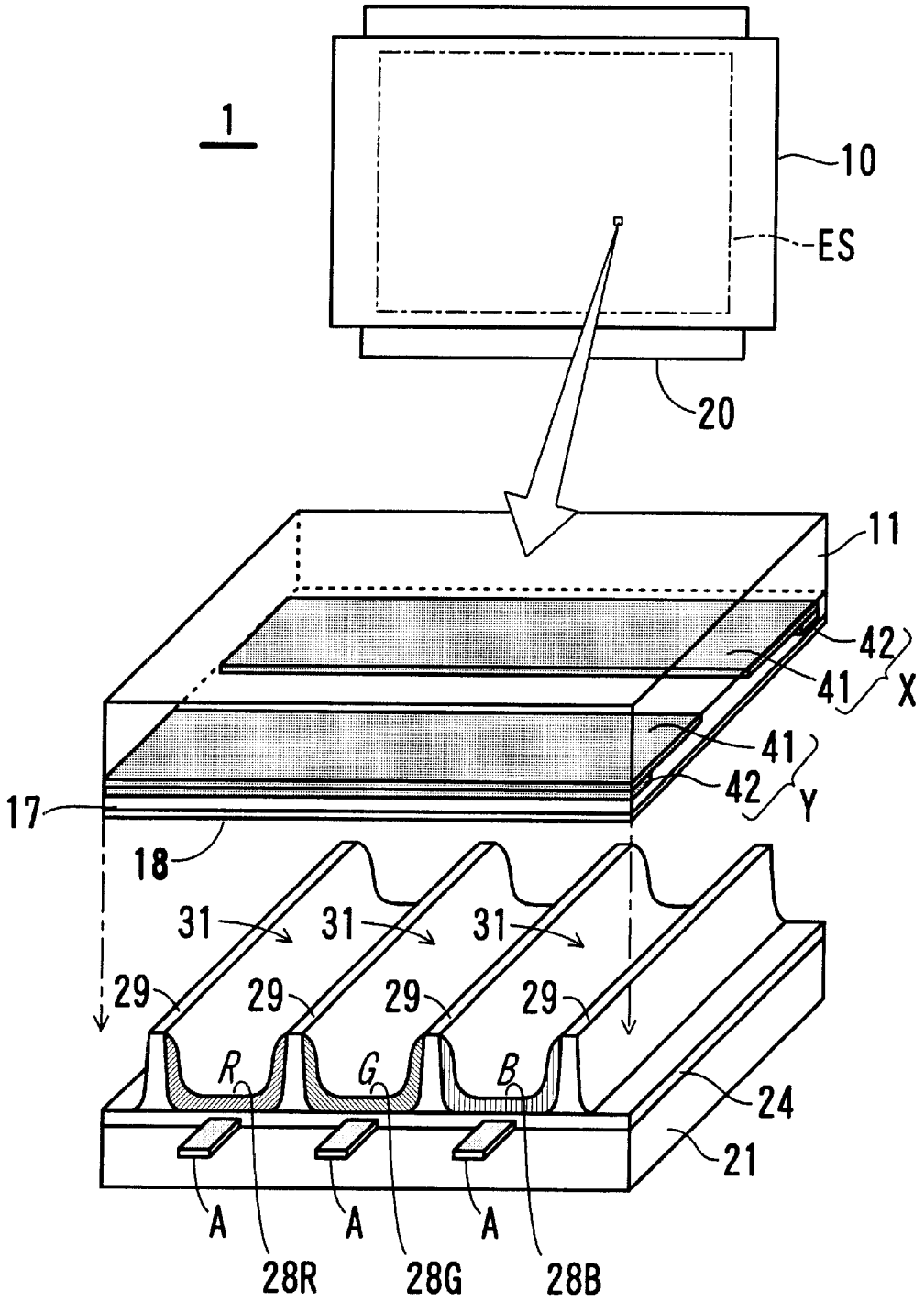
FIG. 2 is a diagram showing a cell structure of a PDP according to the present invention.

FIG. 2 is a diagram showing a cell structure of a PDP according to the present invention. PDP 1 includes a pair of substrate structures (the structure includes a substrate and elements of the discharge cells arranged on the substrate) 10, 20. In each discharge cell of the screen ES, the display electrode pair (the first electrode X and the second electrode Y) and the third electrode A cross each other. The first electrode X and the second electrode Y are arranged on the inner surface of the glass substrate 11 of the front substrate structure 10. Each of them includes a transparent conductive film 41 that forms a surface discharge gap and a metal film (a bus electrode) 42 that extends over the entire length of the row. A dielectric layer 17 having the thickness of approximately 30–50 $\mu$m is provided so as to cover the display electrode pair (X, Y), and the surface of the dielectric layer 17 is covered with a protection film 18 made of magnesia (MgO). The third electrode A is arranged on the inner surface of the glass substrate 21 of the rear substrate structure 20 and is covered with a dielectric layer 24. On the dielectric layer 24, a band-like partition 29 having the height of approximately 150 $\mu$m is provided at each gap between the third electrodes A. The partitions 29 divide the discharge space into plural column parts in the row direction (the horizontal direction of the screen ES). The column space 31 of the discharge space corresponding to each column is continuous over the all rows. Fluorescent material layers 28R, 28G, 28B of red, green and blue colors are provided for color display so as to cover the inner surface of the rear side including the upper side of the third electrode A and the side surface of the partition 29. The italic alphabet characters R, G, B in the figure indicate light emission colors of the fluorescent materials. The fluorescent material layers 28R, 28G, 28B emit light after being excited locally by ultraviolet rays generated by the discharge gas.

Figure 11:
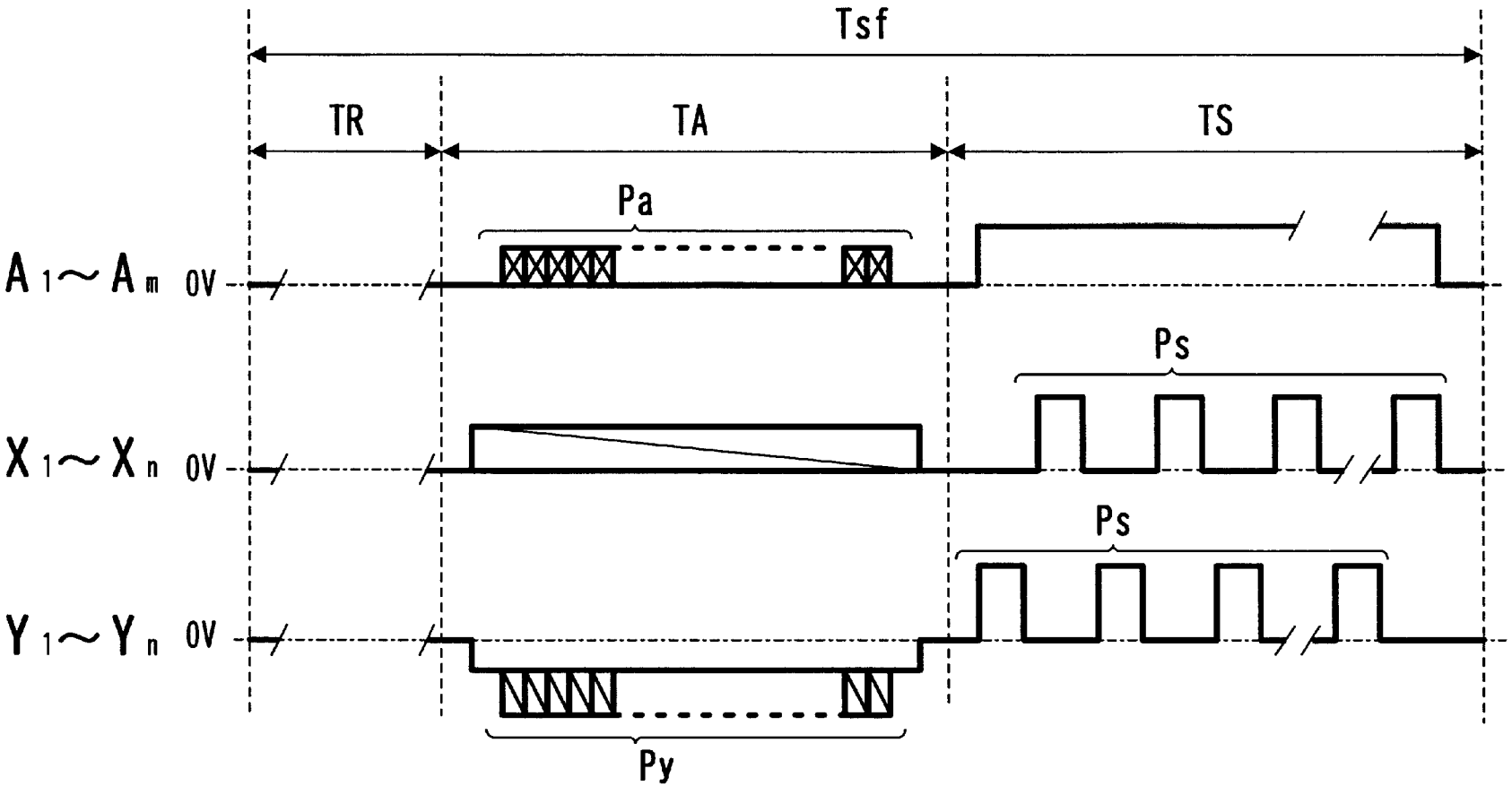
FIG. 11 is a diagram showing voltage waveforms of a general driving sequence.
Figure 12:
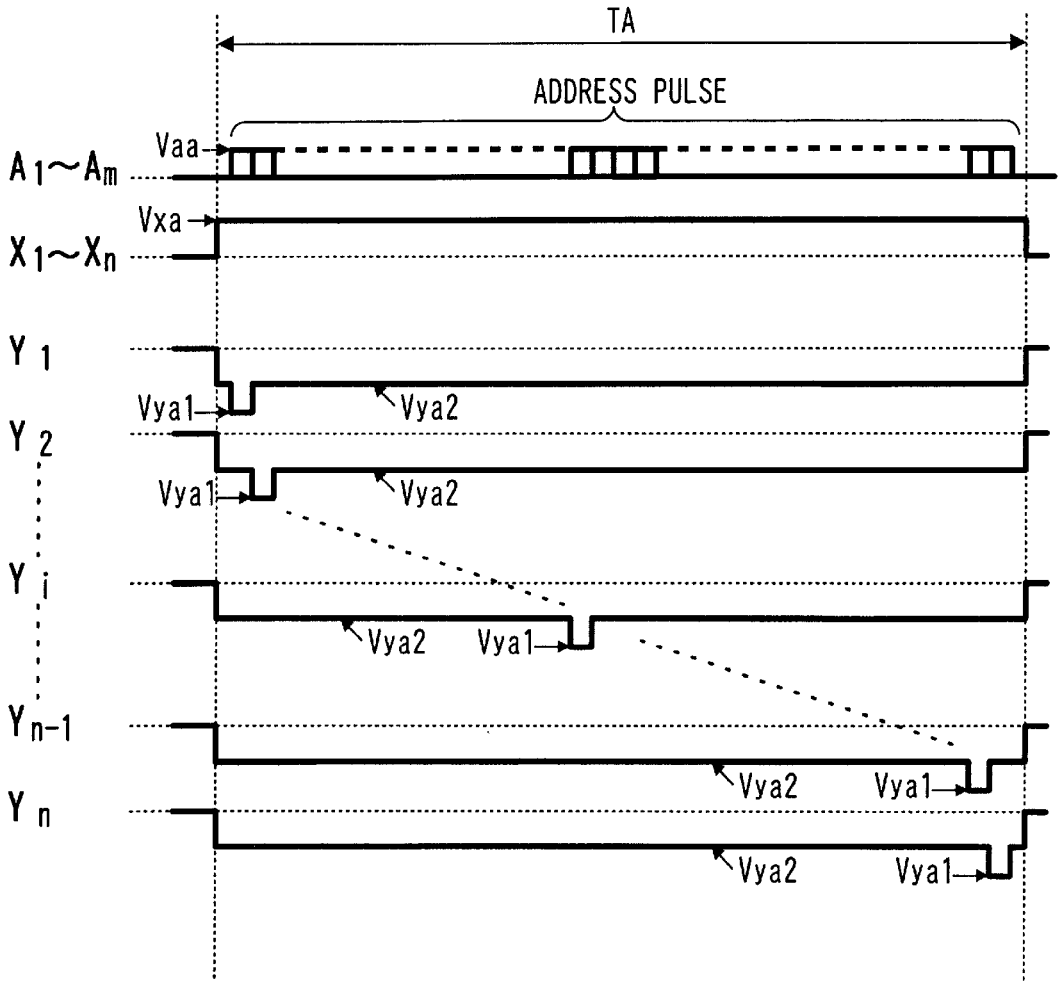
FIG. 12 is a diagram showing driving voltage waveforms in the conventional address period.

In the display, the period of one subfield includes a reparation period TR, an address period TA and a sustaining period TS in the same way as the conventional driving method (see FIG. 11). Hereinafter, the driving form in the address period TA according to the present invention will be explained.

Figure 3:
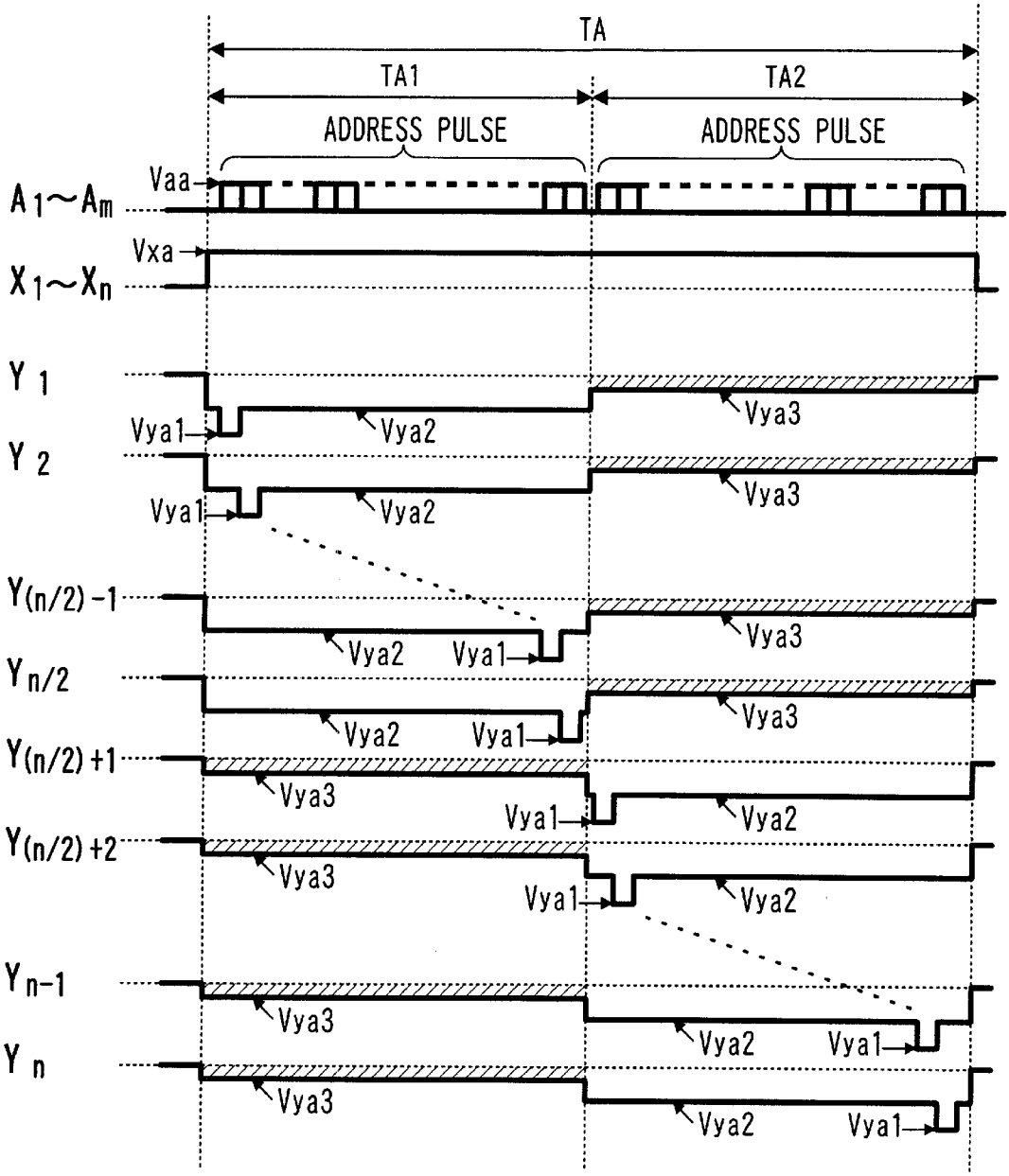
FIG. 3 is a diagram showing a first example of the driving voltage waveform in the address period.

FIG. 3 is a diagram showing a first example of the driving voltage waveform in the address period.

The order of the row selection of the addressing in this example is the same as the arrangement order. The address period TA is divided into two subperiods, i.e., a first half TA1 and a second half TA2. The bias form of the total n/2 of second electrodes $Y_1$-$Y_{n/2}$ that are selected in the first half TA1 is different from that of total n/2 of second electrodes $Y_{(n/2)+1}$-$Y_n$ that are selected in the second half TA2.

In the first half TA1, one of the second electrodes $Y_1$-$Y_{n/2}$ corresponding to the selected row is biased to a selection potential Vya1, and the other second electrodes are biased to a first non-selection potential Vya2. The second electrodes $Y_{(n/2)+1}$-$Y_n$ that are not selected in this period are all biased to a second non-selection potential Vya3. The second non-selection potential Vya3 is closer to the address potential Vaa of the address electrode than to the first non-selection potential Vya2. Sine the illustrated address potential Vaa is a positive potential, the relationship of Vaa>Vya3>Vya2>Vya1 is satisfied. If the address potential Vaa is a negative potential, the relationship Vaa<Vya3<Vya2<Vya1 is satisfied.

In the second half TA2, one of the second electrodes $Y_{(n/2)+1}$-$Y_n$ corresponding to the selected row is biased to the selection potential Vya1, and the other second electrodes are biased to a first non-selection potential Vya2. The second electrodes $Y_1$-$Y_{n/2}$ that are not selected in this period are all biased to a second non-selection potential Vya3.

In this way, the potential of each second electrode Y is switched between Vya1 and Vya2 in the subperiod while the second electrode Y is selected and is maintained at the constant potential Vya3 in the subperiod while the second electrode Y is not selected. This driving waveform is referred to as a "first waveform."

Figure 4:
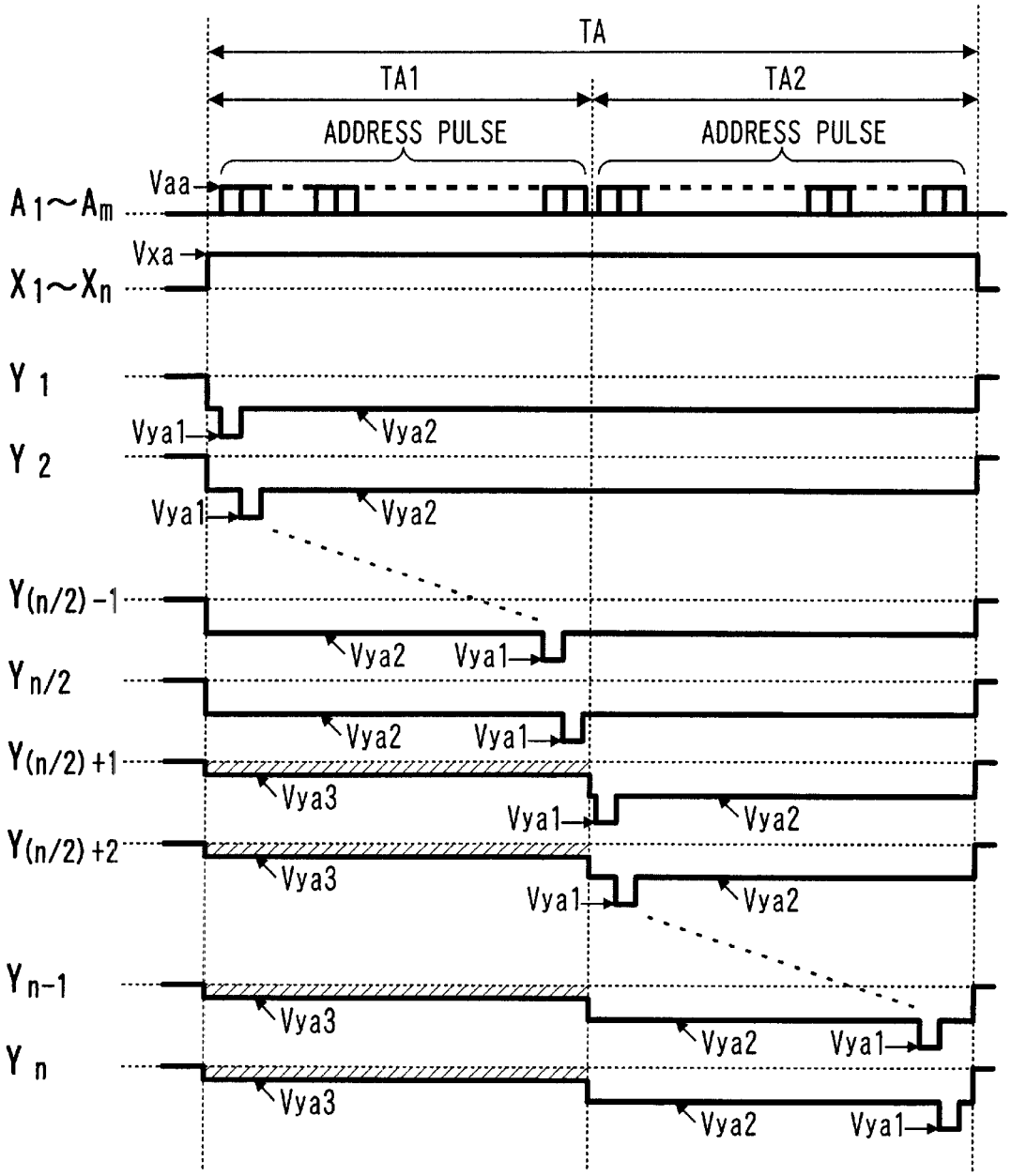
FIG. 4 is a diagram showing a second example of the driving voltage waveform in the address period.

FIG. 4 is a diagram showing a second example of the driving voltage waveform in the address period.

In this example too, the order of the row selection is the same as the arrangement order, and the address period TA is divided into the first half TA1 and the second half TA2.

The driving form of the total n/2 of second electrodes $Y_{(n/2)+1}$-$Y_n$ that are selected in the second half TA2 is the same as the example that was shown in FIG. 3. In contrast, concerning the total n/2 of second electrodes $Y_1$-$Y_{n/2}$ that are selected in the first half TA1, the potential of one corresponding to the selected row is biased to the selection potential Vya1, and others (corresponding to non-selected rows) are biased to the first non-selection potential Vya2 regardless of the first half TA1 and the second half TA2. Namely, in the second half TA2, the second electrodes $Y_1$-$Y_{n/2}$ that are already selected are not biases to the second non-selection potential Vya3, but are maintained at the first non-selection potential Vya2.

In this way, each second electrode Y is biased to either Vya1 or Vya2 in the subperiod while it is selected and the succeeding subperiod, and is maintained at the constant potential Vya3 in the subperiod before the subperiod while it is selected. This driving waveform is referred to as a "second waveform."

Figure 5:
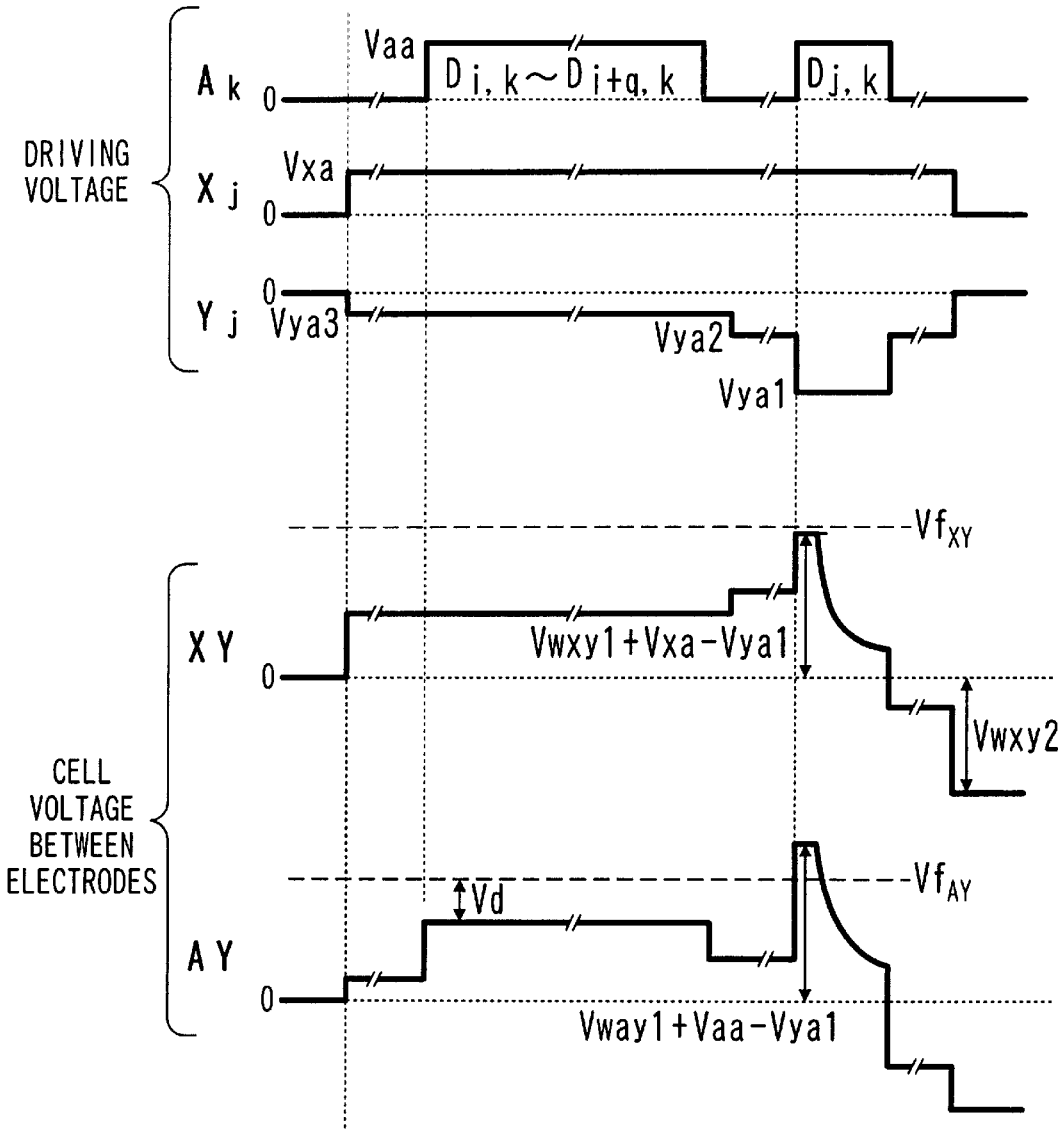
FIG. 5 is a diagram showing a variation of the cell voltage in the address period.

FIG. 5 is a diagram showing a variation of the cell voltage in the address period. In FIG. 5, the display pattern is supposed in the same way as in FIG. 15.

When the second electrode Y is biased to the second non-selection potential Vya3, the difference Vd between the cell voltage of the electrodes A and Y and the discharge starting threshold level $Vf_{AY}$ becomes larger than in the case where it is biased to the first non-selection potential Vya2. Thus, the change of the wall voltage before the row selection becomes hard to occur. As a result, biasing to the selection potential Vya1 at the row selection time point causes the address discharge having a sufficient intensity between the electrodes A and Y and between the electrodes X and Y, so that an appropriate wall voltage Vwxy2 is generated between the electrodes X and Y.

Figure 6:
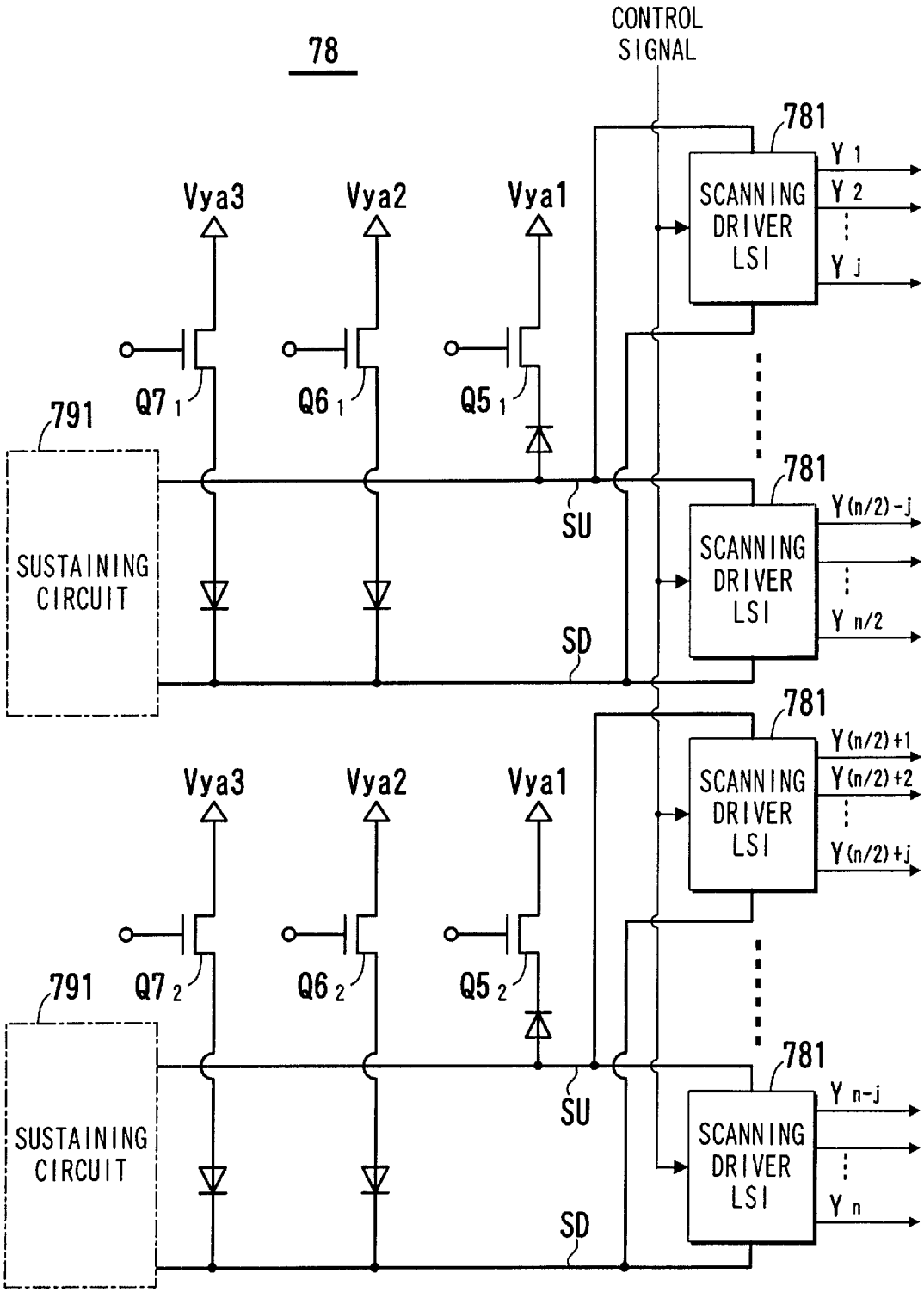
FIG. 6 is a diagram showing the scanning circuit that realizes the first waveform.

FIG. 6 is a diagram showing the scanning circuit that realizes the first waveform.

The scanning circuit 78 includes N (=n/j) of scanning drivers 781 and switches $Q5_1$, $Q5_2$, $Q6_1$, $Q6_2$, $Q7_1$, and $Q7_2$ for switching the voltage that is applied to the scanning drivers. The inner structure of each scanning driver 781 is the same as the conventional circuit (see FIG. 14).

The total N of scanning drivers 781 include a first group for controlling the second electrodes $Y_1$-$Y_{n/2}$ and a second group for controlling the second electrodes $Y_{(n/2)+1}$-$Y_n$. The potential of the power source terminal is switched for each group as a unit. The common driver 79 (see FIG. 1) includes two sustaining circuits 791, one for each group.

In the above-mentioned first half TA1 of the address period, the switch $Q7_1$ is turned off and the switches $Q5_1$, $Q6_1$ are turned on. Namely, the power source terminals SU of N/2 scanning drivers 781 that are included in the first group are biased to the selection potential Vya1, and the power source terminal SD is biased to the non-selection potential Vya2. In this state, the scanning driver 781 is controlled for scanning the second electrodes $Y_1$-$Y_{n/2}$. Concerning the N/2 scanning drivers 781 included in the second group, the switches $Q5_2$, $Q6_2$ are turned off, and the switch $Q7_2$ is turned on so as to bias the power source terminal SD to the second non-selection potential Vya3. When turning on the switch Qa in the scanning driver 781, the second electrodes $Y_{(n/2)+1}$-$Y_n$ are biased to the second non-selection potential Vya3. By turning off the switch $Q5_2$, the power source terminal SU becomes open, so there is no problem even if the potential difference between the selection potential Vya1 and the second non-selection potential Vya3 is larger than the withstand voltage of the scanning driver 781. In the second half TA1 of the address period, the switching control in the first half TA1 is exchanged between the first group and the second group.

Figure 7:
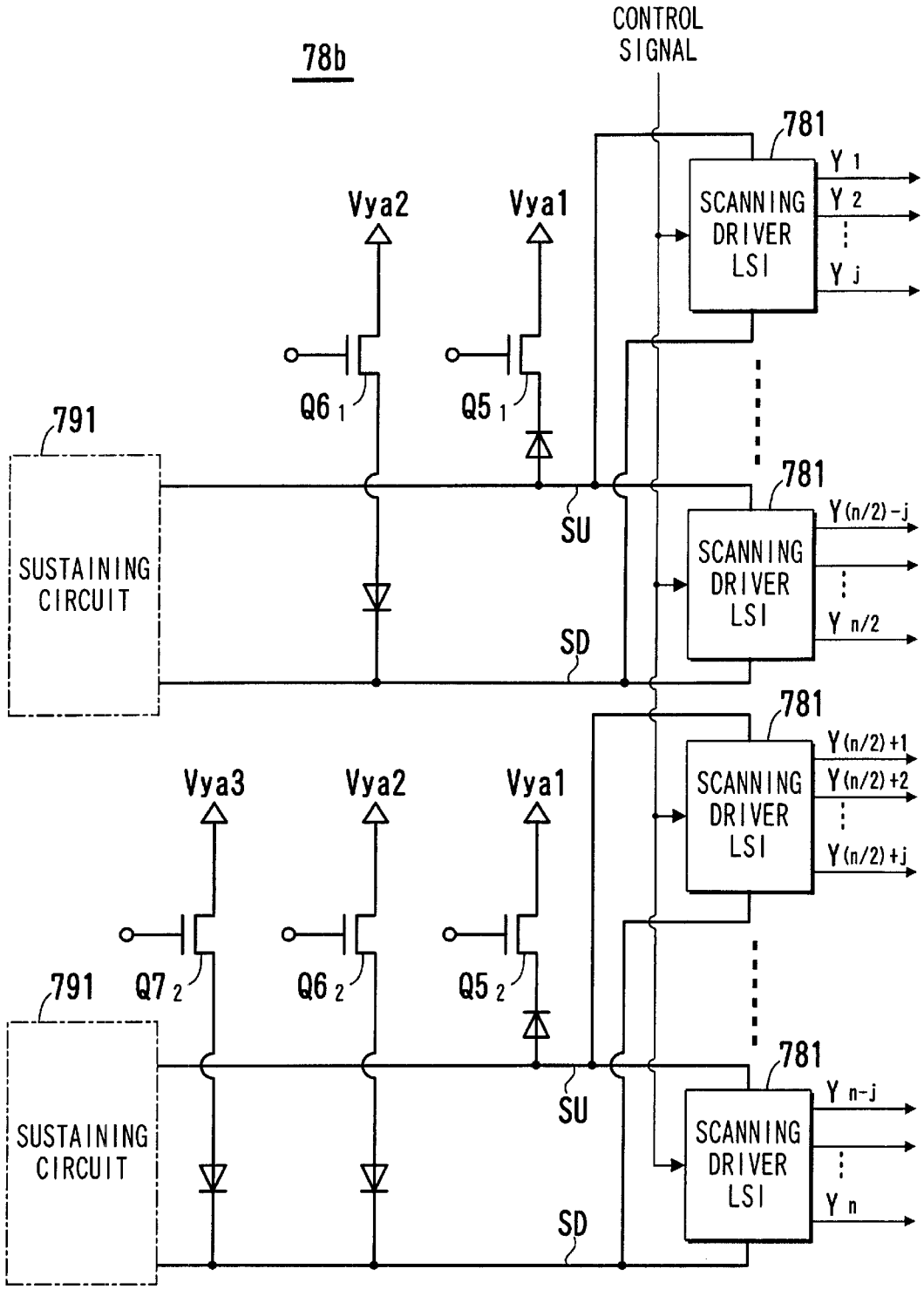
FIG. 7 is a diagram of the scanning circuit that realizes the second waveform.

FIG. 7 is a diagram of the scanning circuit that realizes the second waveform.

The scanning circuit 78*b* corresponds to the circuit in which the switch $Q7_1$ is omitted from the scanning circuit 78 shown in FIG. 6. In the second waveform, the second electrodes $Y_1$-$Y_{n/2}$ that are selected in the first half TA1 are not biased to the second non-selection potential Vya3, so the switch $Q7_1$ can be omitted.

Figure 8:
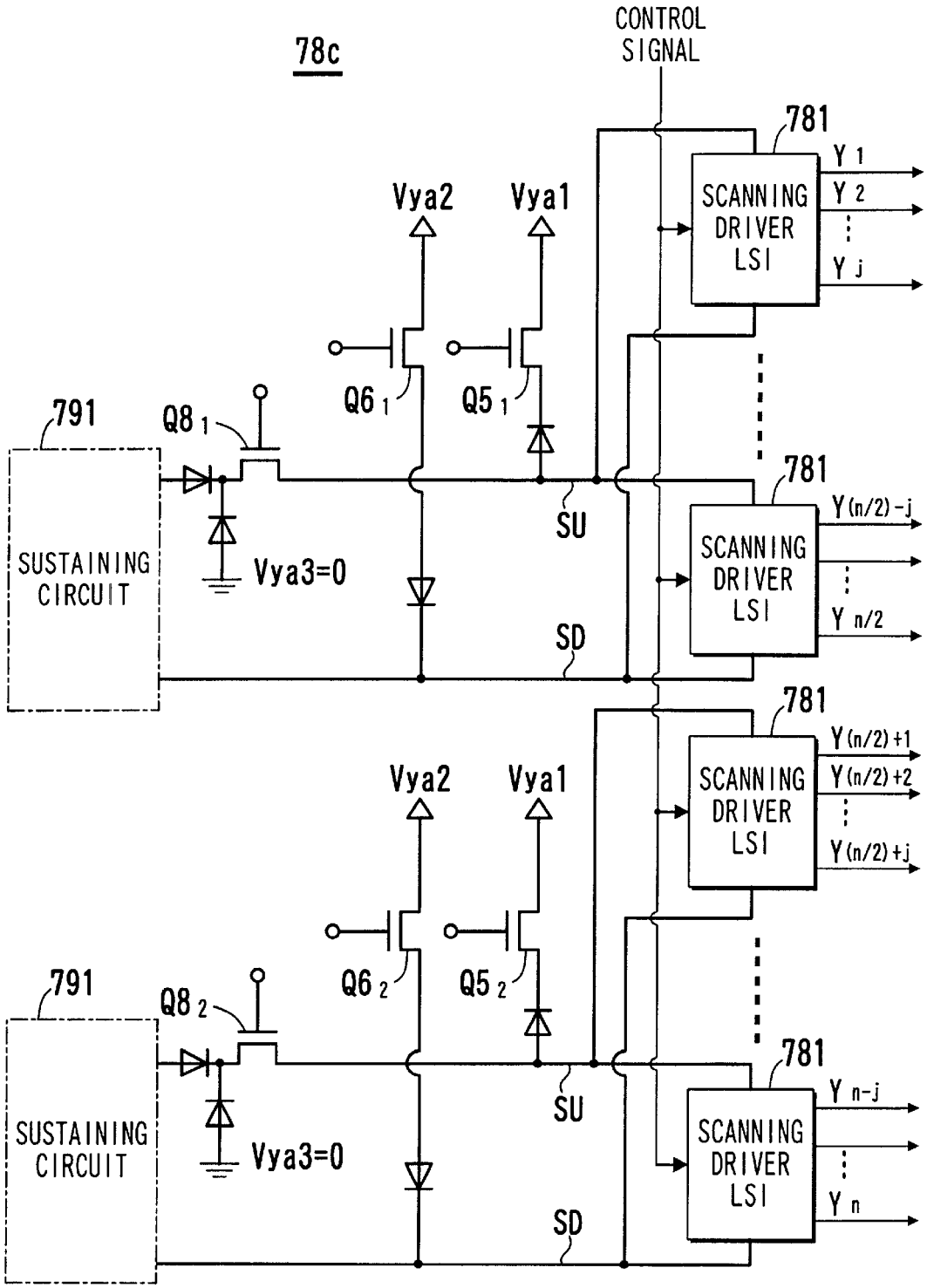
FIG. 8 is a diagram of the scanning circuit in the case where the second non-selection potential is the ground potential.

FIG. 8 is a diagram of the scanning circuit in the case where the second non-selection potential is the ground potential. The second non-selection potential Vya3 can be the ground potential if the relationship of Vaa>Vya3>Vya2>Vya1 is satisfied. In the scanning circuit 78*c*, The switches $Q8_1$, $Q8_2$ that are inserted serially in the output line of the sustaining circuit 791 works for separating the sustaining circuit 791 that supplies the sustaining pulse of the positive polarity and the power source terminals SU, SD when being biased to the negative potential (Vya1, Vya2). When turning on the switches $Q8_1$, $Q8_2$, a current flows in the second electrode Y from the ground via the diode. For example, when a switch (not shown) is turned on for flowing the current to the ground in the sustaining circuit 791 (the lower side in the figure) that corresponds to the block including the switch $Q8_2$ in the same time when the switch $Q8_2$ is turned on in the first half TA1, all the second electrodes $Y_{(n/2)+1}$-$Y_n$ are connected to the ground bi-directional so as to be the ground potential.

In the above explanation, the address period TA is divided into two. However, along with increasing the dividing number, the ratio of period while biasing each second electrode Y to the second non-selection potential Vya3 in the address period TA is increased so that the undesired change of the wall voltage can be suppressed more effectively.

For example, when dividing the address period TA into three subperiods TA1, TA2, TA3, the potential of the second electrode Y can be controlled as shown in Table 1.

TABLE 1

| | | potential of the electrode Y of the corresponding selection order | | |
|---|---|---|---|---|
| | | period TA1 | period TA2 | period TA3 |
| selection order (i < j < n) | 1~i | Vya/Vya2 | Vya3 | Vya3 |
| | (i + 1)~j | Vya3 | Vya1/Vya2 | Vya3 |
| | (j + 1)~n | Vya3 | Vya3 | Vya1/Vya2 |

Figure 9:
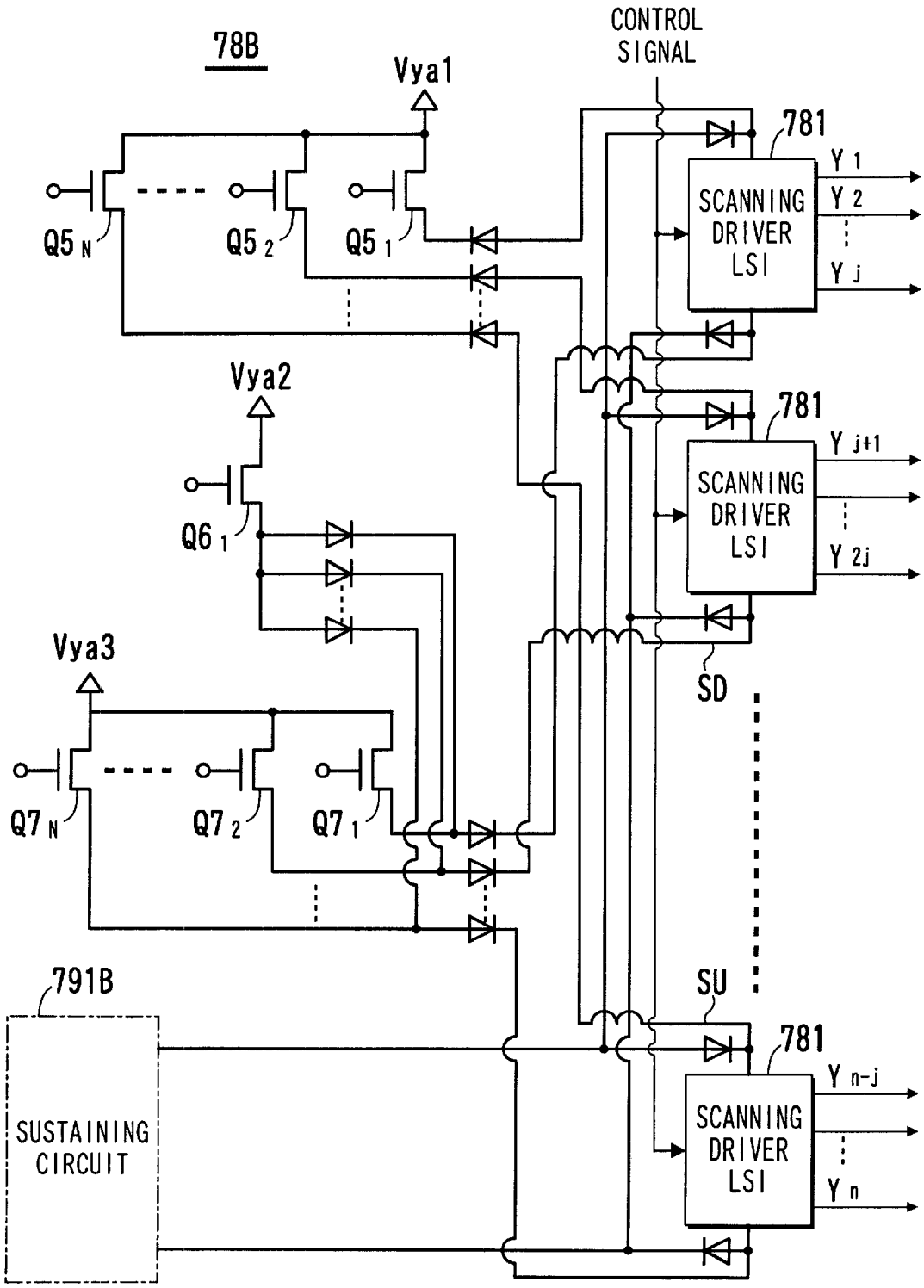
FIG. 9 is a diagram of the scanning circuit according to another example.

FIG. 9 is a diagram of the scanning circuit according to another example.

In the scanning circuit 78B, the dividing number of the address period is the same as that of the scanning driver 781. Though one sustaining circuit 791B is provided for each scanning driver 781, one sustaining circuit 791B can be used as shown in the figure. When connecting the sustaining circuit 791B to the power source terminals SU, SD of the scanning driver 781, the interference of the potentials Vya1, Vya2, Vya3 can be avoided among the scanning drivers in the address period TA by providing the diode.

Figure 10:
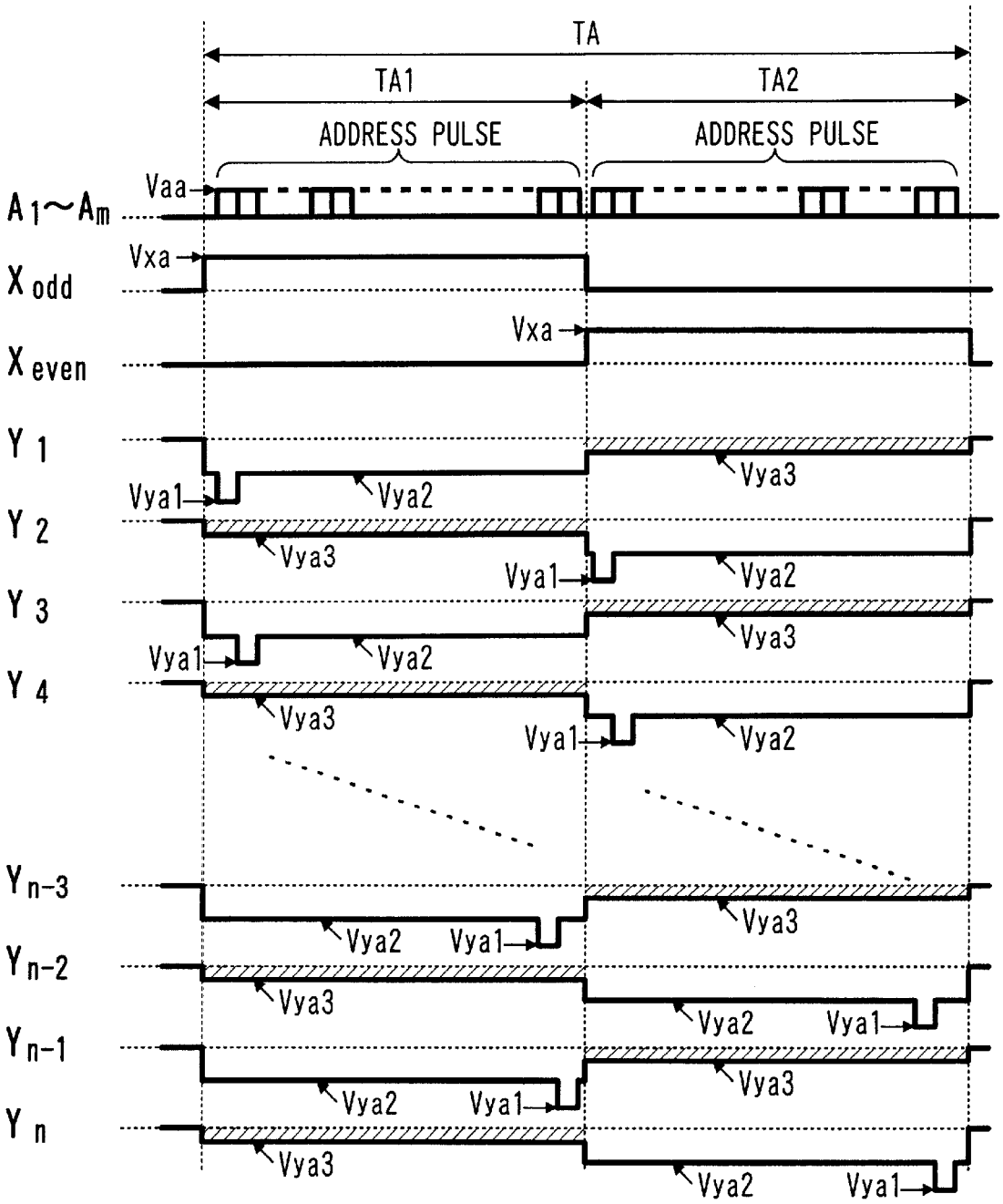
FIG. 10 is a diagram showing a third example of the driving voltage waveform in the address period.

FIG. 10 is a diagram showing a third example of the driving voltage waveform in the address period.

The present invention can be applied to the case where the row selection order is not the same as the arrangement order. For example, when the odd rows are addressed, and then even rows are addressed, the second electrodes Y corresponding to the even rows are biased to the second non-selection potential Vya3 in the first half TA1 as shown in FIG. 10.

The arrangement form of the first electrodes X and the second electrodes Y can be either the form in which a pair of them is arranged in each row or the form in which an electrode is shared by neighboring two rows of display. The number of the second electrode Y is not always an integral multiple of the number j of electrodes of which the scanning driver 781 is in charge. The number of the selected row can be different among the plural subperiods of the address period.

According to the present invention, the addressing that cannot be affected by the change of the operation environment can be realized without increasing the withstand voltage of the circuit components, so that the display can be stabilized.

In addition, since the period while the wall voltage can change easily can be shortened more so that the display can be stabilized more.

In addition, since the special power source for biasing the electrode to the second non-selection potential is not necessary, the cost of the drive circuit can be reduced.

In addition, since the specification of the withstand voltage of the circuit components can be minimized, the switch circuit can be integrated easily.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for driving an AC type PDP that has a screen including first electrode and second electrodes making electrode pairs for surface discharges of plural rows, and third electrodes of plural columns, each third electrode crossing the electrode pairs, the method comprising the steps of:

biasing the second electrode of a selected row to a selection potential Vya1 for row selection;

biasing the third electrode of a selected column to a address potential Vaa that is different from the selection potential Vya1 in synchronization with the row selection so that an addressing discharge can occur;

dividing an address period for the addressing into plural subperiods, so that different rows are selected for subperiods;

switching the bias of the second electrode of the row selected in each subperiod between the selection potential Vya1 and the first non-selection potential Vya2 in accordance with selection and non-selection; and maintaining the potential of the second electrode of the row to be selected in the succeeding subperiod at a second non-selection potential Vya3 that is closer to the address potential Vaa than to the first non-selection potential Vya2.

2. The method according to claim 1, wherein the second electrode of the row that was selected in the previous subperiod is also maintained at the second non-selection potential Vya3 in each subperiod.

3. The method according to claim 1, wherein the second non-selection potential Vya3 is the ground potential.

4. The method according to claim 1, wherein the row selection is performed in the order that is different from the arrangement order of the rows.

5. The method according to claim 1, wherein the address period is divided into two subperiods, in one of the subperiods, the bias of the second electrode of the odd row is switched in accordance with selection and non-selection while the second electrode of the even row is maintained at the second non-selection potential Vya3, and in the other of the subperiods, the bias of the second electrode of the even row is switched in accordance with selection and non-selection while the second electrode of the odd row is maintained at the second non-selection potential Vya3.

6. A device for driving an AC type PDP that has a screen including first electrode and second electrodes making electrode pairs for surface discharges of plural rows, and third electrodes of plural columns, each third electrode crossing the electrode pairs, wherein the device biases the second electrode of a selected row to a selection potential Vya1 for row selection, the device biases the third electrode of a selected column to an address potential Vaa that is different from the selection potential Vya1 in synchronization with the row selection so that an addressing discharge can occur, when dividing an address period for the addressing into plural subperiods, the device switches the bias of the second electrode of the row selected in each subperiod between the selection potential Vya1 and the first non-selection potential Vya2 in accordance with selection and non-selection; and the device maintains the potential of the second electrode of the row to be selected in the succeeding subperiod at a second non-selection potential Vya3 that is closer to the address potential Vaa than to the first non-selection potential Vya2.

7. The device according to claim 6, comprising:

a switch circuit including a first and a second bias terminals for connecting a second electrode to one of the first and second bias terminals;

a first switch for controlling continuity between the first bias terminal and a selection potential line;

a second switch for controlling continuity between the second bias terminal and the first non-selection potential line;

a third switch for controlling continuity between the second bias terminal and the second non-selection potential line; and a controller for opening the third switch in the subperiod while a bias of the second electrode is switched between the selection potential Vya1 and the first non-selection potential Vya2, and for opening the first switch in the subperiod while the potential of the second electrode is maintained at the second non-selection potential Vya3.

8. The device according to claim 7, wherein a withstand voltage between the first and the second bias terminals of the switch circuit is higher than the potential difference between the selection potential Vya1 and the first non-selection potential Vya2 and is lower than the potential difference between the selection potential Vya1 and the second non-selection potential Vya3.

9. The device according to claim 8, wherein the switch circuit is an integrated circuit having plural switching devices for connecting each of the plural second electrodes to one of the first and the second bias terminals.

10. The device according to claim 9, wherein the number of rows selected in each subperiod is equal to the number of driving electrodes per one switch circuit.

11. The device according to claim 9, wherein the number of rows selected in each subperiod is an integral multiple of the number of driving electrodes per one switch circuit.

12. A display device comprising the driving device according to claim 6 and an AC type PDP that is driven by the driving device.

* * * * *